US005224642A

United States Patent [19]

Davis et al.

[11] Patent Number: 5,224,642

[45] Date of Patent: Jul. 6, 1993

[54] PULL WHEEL HAVING SPACED APART FLANGES WITH AN ELASTOMER THEREON

[76] Inventors: Steven D. Davis, 12121 Overcrest, Yuciappa, Calif. 92399; Mark W. Griffin, 22838 Bear Valley #12, Apple Valley, Calif. 92308

[21] Appl. No.: 804,959

[22] Filed: Dec. 11, 1991

[51] Int. Cl.[5] ..... B65H 20/02

[52] U.S. Cl. ..... 226/190; 226/194; 474/179; 492/45

[58] Field of Search ..... 226/190, 191, 188, 194; 29/123, 129; 474/178, 179, 181, 191

[56] References Cited

U.S. PATENT DOCUMENTS

| | | | |
|---|---|---|---|
| 511,606 | 12/1893 | Frink | 29/129 X |
| 733,630 | 7/1903 | Dana | 29/129 |
| 1,376,742 | 5/1921 | Barnett | 474/178 X |
| 2,255,314 | 9/1941 | Graham | 29/129 |
| 2,356,842 | 8/1944 | Helmond | 29/129 X |
| 2,488,729 | 11/1949 | Kooyman | 29/129 |
| 2,636,221 | 4/1953 | Meadows et al. | 29/129 X |
| 2,639,560 | 5/1953 | Cosmos | 29/129 X |
| 4,573,563 | 3/1986 | Delhaes | 29/129 X |
| 4,682,393 | 7/1987 | Corkery | 29/129 X |
| 4,999,968 | 3/1991 | Davis | 53/133.1 |

FOREIGN PATENT DOCUMENTS

| | | | |
|---|---|---|---|
| 0782897 | 12/1980 | U.S.S.R. | 29/129 |

*Primary Examiner*—Daniel P. Stodola
*Assistant Examiner*—Paul T. Bowen
*Attorney, Agent, or Firm*—James G. O'Neill

[57] ABSTRACT

A pull wheel for a form, fill and seal pouch packaging machine has a hub that includes an axially extending central bore and a circumferentially extending peripheral surface that is located radially outwardly from the bore. First and second circumferentially extending flanges are formed integral with and extend radially outwardly from the peripheral surface of the hub. The first and second flanges are axially spaced apart one from the other on the peripheral surface of the hub forming a groove between them. An integrally formed, annular shaped elastomeric body is located radially outwardly from the hub in part within the groove and in further part over and radially outwardly displaced from the first and second flanges such that the periphery of the elastomeric body is displaced radially outwardly from the periphery of the flanges.

15 Claims, 1 Drawing Sheet

PULL WHEEL HAVING SPACED APART FLANGES WITH AN ELASTOMER THEREON

BACKGROUND OF INVENTION

This invention is directed to form, fill and seal pouch packaging machine pull wheels that have two circumferentially extending, but axially separated flanges located on a hub and an elastomeric body located between, over and outside of the flanges.

A variety of products are packaged in film pouches that are formed, filled and sealed on appropriate packaging machines. These machines utilize continuous rolls of film. A pouch is formed from the film, filled with a product and then sealed in a continuous operation. These machines are referred to as form, fill and seal pouch packaging machines.

To form pouches on such form, fill and seal pouch packaging machines, side seams are first formed between front and back films via side seals. A cross seal is then utilized to form a bottom seam. This three sided pouch is then filled with product and the machine in indexed. A further cross seal is now utilized to form the top seam on the filled pouch and concurrently the bottom seam on the next partly formed, but still empty pouch. The empty pouch is filed and the machine is once again indexed to continue the cycle.

When the machine is indexed, pull rollers are utilized to engage the film and advance it with respect to both the side seals and the cross seals. A typical pouch packaging machine is capable of concurrently forming a linear array of side to side pouches across the width of the machine. The number of side by side pouches that are concurrently formed can vary from a single pouch, when large pouches are being formed, to multiple pouches, when narrow pouches are being formed. Depending upon the number of pouches that are being formed across the width of the machine, a number of side seams will be formed between the films. An equal number of pull wheels are generally utilized in conjunction with the side seams to advance the film on the machine.

The pull wheels are generally utilized in opposing pairs. A front member of the pair is located on one side of the film and a back member of the pair is located on the other side of the film. Normally, all of the front members of pairs of pull wheels are located on a single shaft on the front side of the film and in a like manner all of the back members of the pairs are located on a single shaft on the back side of the film.

Normally all the front pull wheels, or all the back pull wheels or both sets of pull wheels will be fixed to their appropriate shafts so as to be positively rotated in conjunction with rotation of the shafts. Each time the machine is indexed the drive shaft is rotated and this in turn rotates the pull wheels. After each indexing of the machine, the pull wheel drive shaft is stopped and this in turn stops the pull wheels. The pull wheels are thus started and stopped with each index of the machine. This acceleration and deceleration of the pull wheels with each indexing of the machine is very stressful to the normal elastomeric covering that is located on the pull wheels for gripping the film. Since the typical form, fill and seal pouch packaging machine are operated at a high rate of speed, the pull wheels are continuously being accelerated and decelerated.

While presently known pull wheels are useful over many cycles, because the pouch packaging machines are run at high rates of speed, pull wheel failure can occur in a matter of days. If the elastomeric material that is normally laminated to the pull wheel delaminates or otherwise disintegrates, splits or the like, the machine must be taken off line and the pull wheel or pull wheels replaced. This is a time consuming and thus labor intensive operation. Because replacement of the pull wheels requires taking the form, fill and seal pouch packaging machine off line, it is both an annoyance and an economic disadvantage.

Heretofore, attempts have been made to increase the life time of form, fill and seal pouch packaging machine pull wheels by improving the elastomers that are utilized on the pull wheels. However, since to advance the film on the packaging machine the elastomer of the pull wheel must grip the film without damaging it, certain properties of the elastomer, i.e. suppleness and flexibility, must be maintained. Thus, replacement of the elastomeric material alone has not solved the need for pull wheels having longer, useful lifetimes.

BRIEF DESCRIPTION OF THE INVENTION

In view of the above it is an object of this invention to provide for new and improved pull wheel designs for use on form, fill and seal pouch packaging machines.

It is a further object to provide for improved pull wheel designs that yield pull wheels having extended lifetimes while still maintaining desirable characteristics of current pull wheel designs.

These and other objects as will become evident from the remainder of this specification are achieved in a pull wheel for a form, fill and seal pouch packaging machine that includes a hub having an axially extending central bore and a circumferentially extending peripheral surface that is located radially outwardly from the bore. First and second circumferentially extending flanges are formed integral with and extend radially outwardly from the peripheral surface of the hub. The first and second flanges are axially spaced apart from one another on the peripheral surface of the hub so as to form a groove between them. A first plurality of openings extend axially through the first flange and a second plurality of openings extend axially through the second flange. An integrally formed annular shaped elastomeric body is located radially outwardly from the hub in part in the groove, in further part in the first and second plurality of openings and in even further part over and radially outwardly displaced from the first and second flanges such that the periphery of the elastomeric body is displaced radially outwardly from the periphery of the flanges.

In a preferred embodiment of the invention the hub further includes an attaching means for fixedly attaching the hub to a shaft passing through the bore of the hub. In a further preferred embodiment the openings in the first and second flanges are axially misaligned with one another. Additionally, the openings can be countersunk openings shaped in a truncated conical shape.

Further, in accordance with this invention there is provided a pull wheel for a form, fill and seal pouch packaging machine that includes a hub having an axially extending central bore and a circumferentially extending surface that is located radially outwardly from the bore. The hub has a first side surface and a second side surface that are separated from each other by a peripheral surface. First and second circumferentially extending flanges, each of which have an inside side surface and an outside side surface, are integrally formed with and extend radially outwardly from the peripheral surface of the hub. The first and second flanges are axially spaced apart one from the other on the peripheral surface of the hub so as to form a groove between the inside surfaces of the flanges. The first flange is located on the peripheral surface of the hub proximal to but spaced away from the first side surface of the hub. As so located a first stepped shoulder is formed between the first side surface of the hub and the outside side surface of the first flange. The second flange is located on the peripheral surface of the hub proximal to but spaced away from the second side surface of the hub. As so located a second stepped shoulder is formed between the second side surface of the hub and the outside side surface of the second flange. An integrally formed annular shaped elastomeric body is located radially outward from the hub in part in the groove, in further part over the outside surfaces of the first and second flanges and even in further part over and radially outwardly displaced from the first and second flanges such that the periphery of the elastomeric body is displaced radially outwardly from the periphery of the flanges.

In a preferred embodiment of the invention the peripheral surface of the hub that is located between the inside surfaces of the first and second flanges forms a bottom of the groove. This bottom includes a plurality of circumferentially extending groove channels located therein. The elastomeric body is adhered to these grooved channels. In a further embodiment of the invention the outside surfaces of the first and second flanges between the stepped shoulders and the periphery of the flanges each include a plurality of concentrically located circumferentially extending side channels. The elastomeric body is further adhered to these side channels.

In a preferred embodiment of the invention the first and second stepped shoulders are essentially axially aligned with one another. Further, the first and second stepped shoulders can be further essentially axially aligned with the peripheral surface of the hub.

BRIEF DESCRIPTION OF THE DRAWINGS

This invention will be better understood when taken in conjunction with the drawings wherein.

This invention utilizes certain principles and/or concepts as are set forth in the claims appended hereto. Those skilled in the packaging arts will realize that these principles and/or concepts are capable of being utilized in a variety of embodiments that may differ from the embodiment utilized herein for illustrative purposes. For this reason this invention is not to be construed as being limited solely to the illustrative embodiments, but should only be construed in view of the claims appended hereto.

DETAILED DESCRIPTION OF THE INVENTION

Figure 1:
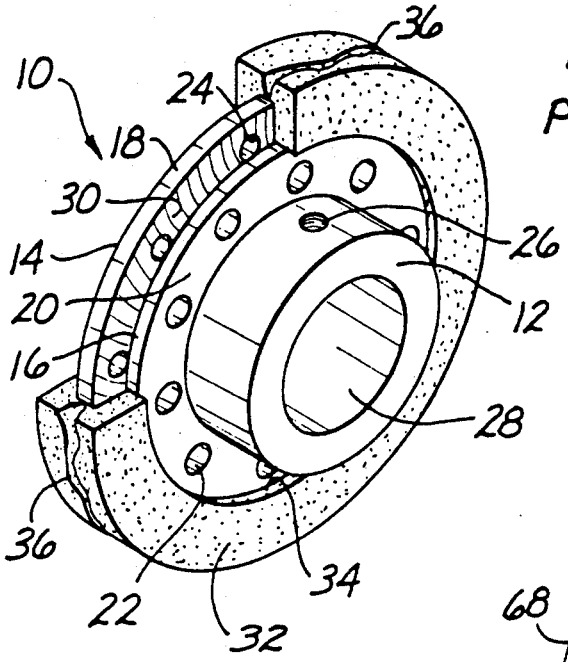
Fig. 1 PRIOR ART
FIG. 1 is an isometric view in partial section of a prior art pull wheel for use on form, fill and seal pouch packaging machines.

A variety of form, fill and seal pouch packaging machines are known. Typical of these pouch machines are those described in U.S. Pat. Nos. 4,768,330; 4,769,974; 4,845,926; and 4,996,819 each of which is assigned to the same assignee as this application and each of which, in its entirety, is herein incorporated by reference. The form, fill and seal pouch packaging machines of each of these patents utilize pull wheels of a design as is shown in FIG. 1 of the drawings. While these pull wheels are certainly functional and of utilitarian value, the elastomer of these prior art pull wheels tends to split and then separate and delaminate from the pull wheel thus shortening the useful lifetime of the pull wheel.

Illustrated in FIG. 1 is a prior art pull wheel 10. The pull wheel 10 is composed of a hub 12 having a central flange 14 integrally formed therewith. The central flange 14 has a stepped shoulder 16 that separates a thin, outer rim area 18 from a thicker core area 20. A plurality of openings, collectively identified by the numeral 22, are drilled to the core area 20 to reduce the mass in the core area. A further plurality of openings 24, are drilled in the rim area 18. The hub 12 includes a threaded drilling 26 for accepting an appropriate hex head screw for securing the hub 12 and therefore the pull wheel 10 to an appropriate shaft (not illustrated) that passes through a central opening 28 in the hub 12.

Located along the side edges of the rim area 18 are a plurality of grooves 30 which together essentially form a knurled area on the sides of the rim area 18 to assist in gripping of an elastomer 32 to the rim area 18. The elastomer 32 is molded around the hub 12 and forms an integral annulus that adheres to the rim area 18 via the grooves 30. The elastomer 32 is further adhered to the rim area 18 via small elastomeric locking bridges that form in the openings 24 between the portions of the elastomer 32 that straddle the rim area 18.

In molding the elastomer 32 to the hub 12, a wall 34 of the elastomeric material extends outwardly from and beyond the shoulder 16 such that the width of the elastomer 32 is sufficiently wider than the width of the flange 14 either at the rim area 18 or the core area 20.

In use, the pull wheel 10 is totally satisfactory except for its longevity. In continued use the elastomer 32 inevitably forms a split 36, seen in FIG. 1, that traverses circumferentially around the totality of the elastomer 32. This split is located directly over the thin rim area 18. While initially this split 36 simply divides the elastomer 32 into halves, eventually the elastomer 32 delaminates from the knurled grooves 30, tears along the portions of the material that pass through the openings 24 and separates entirely from the rim area 18 of the pull wheel 10. When this happens the pull wheel is no longer functional and it must be removed from the form, fill and seal pouch packaging machine.

While the hub portion 12 of the pull wheel 10 can be stripped and cleaned of all old elastomer and recycled by re-molding new elastomer 32 thereon, such recycling is somewhat unsatisfactory since the pull wheel 10 must be removed from the form, fill and seal pouch packaging machine and sent back to the manufacturer for reprocessing.

Figure 2:
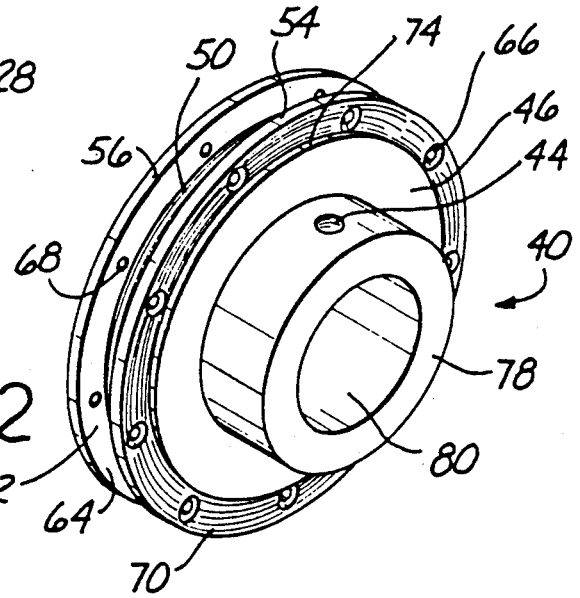
FIG. 2 is an isometric view of the hub and flange portion of a pull wheel of the invention for use on form, fill and seal pouch packaging machines.
Figure 3:
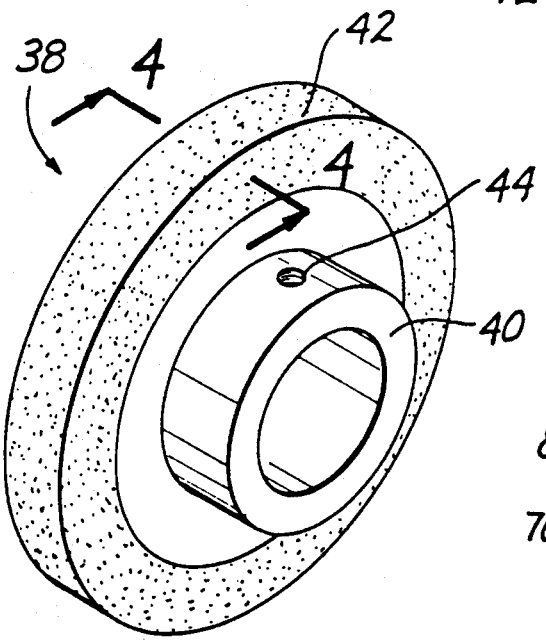
FIG. 3 is an isometric view of a complete pull wheel of the invention for use on form, fill and seal pouch packaging machines.
Figure 4:
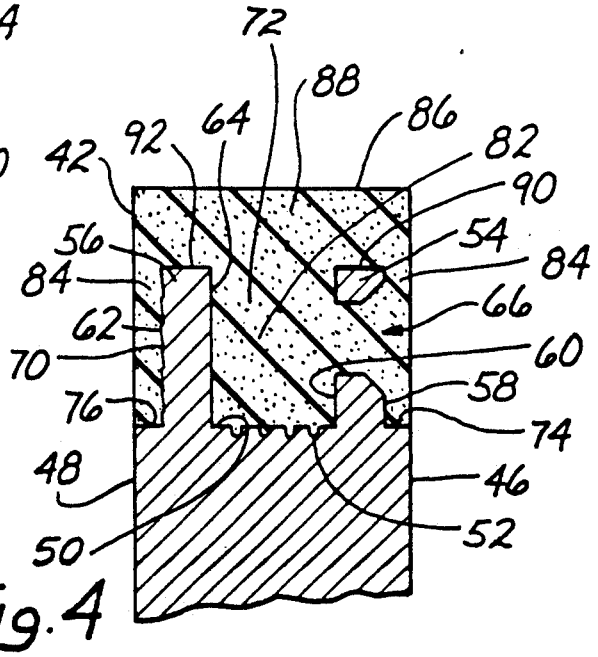
FIG. 4 is a fragmentary sectional view about the line 4—4 of FIG. 3.

Shown in FIGS. 2, 3 and 4, is an improved pull wheel of this invention. In FIG. 3, a pull wheel 38 of the invention is illustrated as it is used on a form, fill and seal pouch packaging machine. The pull wheel 38 has two main components, a hub portion 40 and an elastomer 42. The hub 40 includes an opening 44 that accepts a threaded hex head screw for securing the pull wheel 38 to a pull wheel shaft (not illustrated) of a form, fill and seal and pouch packaging machine. While externally the pull wheel 38 of FIG. 3 looks similar to the pull wheel 10 of FIG. 1, there are underlying structural differences between these two pull wheels that result in entirely different performance characteristics of the pull wheel 38 as operated on a form, fill and seal pouch packaging machine.

The pull wheel 38 of FIG. 3 is not susceptible to splitting of its elastomer 42 as per the circumferentially extending split 36 of the pull wheel 10 of FIG. 1. Indeed, when the pull wheel 38 was tested as to longevity compared to the pull wheel 10, pull wheel 38 exhibits superior performance. It was not prone to the formation of circumferentially extending splits in its elastomer 42.

The hub 40 of the pull wheel 38 is shown in greater detail in FIG. 2. The hub 40 includes a front side wall 46 and a similar back side wall 48 (as identified in FIG. 4). Between the front and back side walls 46 and 48 is a peripheral wall 50. As is best seen in FIG. 4 the peripheral wall 50 includes a plurality of circumferentially extending channels 52 located therein.

Extending radially outwardly from the peripheral wall 50 is a first flange 54 and a second flange 56. The first flange 54 has an outside wall 58 and an inside wall 60. Likewise the second flange 56 has an outside wall 62 and an inside wall 64. Extending between the outside and inside walls 58 and 60 of the first flange 54 are a plurality of openings collectively identified by the numeral 66. In a like manner extending between inside and outside walls 62 and 64 of the second flange 56 are a plurality of openings collectively identified by the numeral 68. The openings 66 and 68 are preferably located such that they are displaced circumferentially from one another, i.e. they are misaligned along an axial direction passing through the hub 40. This displacement can be seen in FIG. 4 wherein the opening 66 of the first flange 54 is seen along the section line whereas a corresponding opening is not seen along the same section line through the second flange 56.

Each of the openings 66 and 68 are countersunk from their outside wall towards their inside wall. This is seen for the opening 66 in the sectional view of FIG. 4. Further, in the outside wall 58 of the first flange 54 and in the outside wall 62 of the second flange 56 are a plurality of concentric circularly extending channels, collectively identified by the numeral 70, for both the flanges 54 and 56. Additionally, the inside wall 60 of the first flange 54 and the inside wall 64 of the second flange 56 in combination with the peripheral wall 50 of the hub 40 form a groove 72.

The first flange 54 is located on the peripheral wall 50 in a position such that it is spaced inwardly from the front side wall 46 of the hub 40. This forms a first stepped shoulder 74. In a like manner the second flange 56 is spaced inwardly from the back side wall 48 to form a second stepped shoulder 76. The stepped shoulders 74 and 76 are essentially axially aligned with one another on the peripheral wall 50 of the hub 40. The portion of the peripheral wall 50 in between the first and second flanges 54 and 56 can be considered to be the bottom of the groove 72. When so considered, the stepped shoulders 74 and 76 are also essentially axially aligned with this bottom of the groove 72.

An axially extending section 78 of the hub 40 includes a central bore 80 therein which is sized to fit over a pull wheel drive shaft on a form, fill and seal pouch packaging machine. A threaded fastener is then inserted through the threaded opening 44 to fixedly attach the hub 40 to such a drive shaft.

An elastomer 42 is molded onto the hub 40 such that a portion of the elastomer, identified by the numeral 82 in FIG. 4, is located within the groove 72. A further portion of the elastomer, identified by the numeral 84, is located on both the left and right sides of the hub 40 external of the outside walls 58 and 62 of the first and second flanges 54 and 56, respectively. This portion of the elastomer extends from the stepped shoulders 74 and 76 upwardly to the periphery 86 of the elastomer 42. An even further portion of the elastomer 42 is located in the openings 66 and 68. The remaining portion of the elastomer, identified by the numeral 88 in FIG. 4, is located radially outwardly from the peripheral surfaces 90 and 92, respectively, of the first and second flanges 54 and 56.

The elastomer 42 is retained in part on the hub 40 via locking through the openings 66 and 68 in the flanges 54 and 56, in further part via interlocking with the channels 52 in the peripheral wall 50 and even in further part via interlocking with the channels 70 on the outside walls of the flanges 54 and 56. Additionally, the elastomer 42 adheres to the hub 40 by virtue of its shape, that is it is an annulus that completely surrounds and encircles the hub 40 and includes the inwardly projecting portion 82 that is physically locked in the groove 72 between the flanges 54 and 56. Contrary to the split 36 formed in the prior art pull wheel 10 of FIG. 1, in the pull wheel 38 of FIGS. 2, 3 and 4, no such splitting has so far been observed even with extended use of the pulls wheels 38.

The elastomer 42 is generally selected as a silicone rubber of a hardness of about 60 shore. It is compress molded around the hub 40. The side surfaces of the elastomer 42 are formed as flat planar extensions of the side walls 46 and 48 of the hub 40. This is quite different from the elastomer 32 of the prior art pull wheel 10 of FIG. 1 wherein the elastomer is of a significantly greater width than that of the widest part of the pull wheel, i.e. the core area 20 on which it is molded. As opposed to the shoulder 16 of the prior art pull wheel 10 of FIG. 1 that only supports a portion of the elastomer 32, the stepped shoulders 74 and 76 of the pull wheel 38, as best seen in FIG. 4, fully support the outside surface of the elastomer 42.

For the sake of illustration, the holes 66 and 68 have been shown as round openings which are countersunk into the outside surfaces 58 and 62 of the first and second flanges 54 and 56. While this construction is preferred, other shaped openings could be utilized, as for instance slots and the like. The round, countersunk openings are preferred since they are easily machined into the part and since the elastomeric material forms a strong bridge from the outside of the flanges to the inside of the flanges through these openings.

We claim:

1. A pull wheel for a form, fill and seal pouch packaging machine comprising:

a hub;

said hub having an axially extending central bore, said hub including a circumferentially extending peripheral surface that is located radially outwardly from said bore;

first and second circumferentially extending flanges formed integral with and extending radially outwardly from said peripheral surface of said hub, said first and second flanges axially spaced apart from one another on said peripheral surface of said hub so as to form a groove between said flanges;

a first plurality of openings axially extending through said first flange;

a second plurality of openings axially extending through said second flange;

said first plurality of openings in said first flange and said second plurality of openings in said second flange are circumferentially displaced with respect to one another; and an integrally formed annular shaped elastomeric body located radially outwardly from said hub in part in said groove, in further part in said first and second plurality of openings and in further part over and radially outwardly displaced from said first and second flanges such that said periphery of said elastomeric body is displaced outwardly from the periphery of said first and second flanges.

2. A pull wheel of claim 1 wherein:

at least a portion of each of said openings is countersunk and has a truncated conical shape.

3. A pull wheel of claim 1 including:

said hub having a first side surface and a second side surface separated from each other by said peripheral surface of said hub;

said first and said second flanges each having an inside side surface and an outside side surface;

said first and second flanges axially spaced apart from one another on said peripheral surface of said hub so as to form said groove between said inside side surfaces of said first and said second flanges;

said first flange located on said peripheral surface of said hub proximal to but spaced away from said first side surface of said hub so as to form a first stepped shoulder between said first side surface of said hub and said outside side surface of said first flange; and said second flange located on said peripheral surface of said hub proximal to but spaced away from said second side surface of said hub so as to form a second stepped shoulder between said second side surface of said hub and said outside side surface of said second flange.

4. A pull wheel of claim 3 including:

a further part of said elastomeric body located over said outside surfaces of said first and said second flanges and extending over said outside surface of said first and second flanges from said first and second stepped shoulders to said periphery of said elastomeric body.

5. A pull wheel of claim 4 including:

said outside surfaces of said first and second flanges between said stepped shoulders and the periphery of said flanges each including a plurality of concentric circumferentially extending side channels located therein; and said elastomeric body adhering to said side channels.

6. A pull wheel of claim 3 including:

said peripheral surface of said hub located between said inside surfaces of said first and second flanges forming a bottom surface of said groove;

said bottom surface of said groove including a plurality of circumferentially extending groove channels located therein; and said elastomeric body adhering to said groove channels.

7. A pull wheel of claim 3 wherein:

said first and said second stepped shoulders are essentially axially aligned with each other.

8. A pull wheel of the claim 7 wherein:

said first and said second stepped shoulders are further essentially axially aligned with said peripheral surface of said hub.

9. A pull wheel for a form, fill and seal pouch packaging machine comprising:

a hub;

said hub having an axially extending central bore, said hub including a circumferentially extending peripheral surface that is located radially outwardly from said bore;

said hub having a first side surface and a second side surface separated from each other by said peripheral surface of said hub;

first and second circumferentially extending flanges each having an inside surface and an outside surface, said first and second flanges each formed integral with and extending radially outwardly from the peripheral surface of said hub;

said first and second flanges axially spaced apart from one another on said peripheral surface of said hub so as to form a groove between said inside side surface of said first and second flanges;

said first flange located on said peripheral surface of said hub proximal to but spaced away from said first side surface of said hub so as to form a first stepped shoulder between said first side surface of said hub and said outside side surface of said first flange;

said second flange located on said peripheral surface of said hub proximal to but spaced away from said second side surface of said hub so as to form a second stepped shoulder between said second side surface of said hub and said outside side surface of said second flange;

a first plurality of openings axially extending through said first flange;

a second plurality of openings axially extending through said second flange;

said first plurality of openings in said first flange and said second plurality of openings in said second flange are circumferentially displaced with respect to one another; and an integrally formed annular shaped elastomeric body located radially outwardly from said hub in part in said groove, in further part in said first and second plurality of openings, in further part over said outside surfaces of said first and second flanges and in further part over and radially outwardly displaced from said first and second flanges such that said periphery of said elastomeric body is displaced outwardly from the periphery of said first and second flanges.

10. A pull wheel of claim 9 including:

said peripheral surface of said hub located between said inside surfaces of said first and second flanges forming a bottom of said groove;

said bottom surface of said groove including a plurality of circumferentially extending groove channels located therein; and said elastomeric body adhering to said groove channels.

11. A pull wheel of claim 10 including:

said outside surfaces of said first and second flanges between said stepped shoulders and the periphery of said flanges each including a plurality of concentric circumferentially extending side channels located therein; and said elastomeric body adhering to said side channels.

12. A pull wheel of claim 9 including:

said outside surfaces of said first and second flanges between said stepped shoulders and the periphery of said flanges each including a plurality of concentric circumferentially extending side channels located therein; and said elastomeric body adhering to said side channels.

13. A pull wheel of claim 9 wherein:

said first and second stepped shoulders are essentially axially aligned with each other.

14. A pull wheel of the claim 13 wherein:

said first and said second stepped shoulders are further essentially axially aligned with said peripheral surface of said hub.

15. In combination with a form, fill and seal pouch packaging machine, a pull wheel comprising:

a hub;

said hub having an axially extending central bore, said hub including a circumferentially extending peripheral surface that is located radially outwardly from said bore;

said hub adapted to be fixedly attached by said hub to said form, fill and packaging machine;

first and second circumferentially extending flanges formed integral with and extending radially outwardly from the peripheral surface of said hub, said first and second flanges axially spaced apart from one another on said peripheral surface of said hub so as to form a groove between said flanges on said peripheral surface of said hub;

a first plurality of openings axially extending through one of said first and second circumferentially extending flanges;

a second plurality of openings axially extending through the other of said first and second circumferentially extending flanges, with said second plurality of openings circumferentially displaced with respect to said first plurality of openings; and an integrally formed annular shaped elastomeric body located radially outwardly from said hub in part in said groove, in further part in said first and second plurality of openings, and in further part over and radially outwardly displaced from said first and second flanges such that said periphery of said elastomeric body is displaced radially outwardly form the periphery of said flanges.

* * * * *